US009814327B2

(12) United States Patent
Giulietti

(10) Patent No.: US 9,814,327 B2
(45) Date of Patent: Nov. 14, 2017

(54) DISPLAY PROVIDED WITH AUTOMATICALLY AND MANUALLY OPERABLE REVOLVING DOOR PANELS

(71) Applicant: INDUSTRIE SCAFFALATURE ARREDAMENTI—ISA S.R.L., Bastia Umbra (PG) (IT)

(72) Inventor: Marco Giulietti, Bastia Umbra (IT)

(73) Assignee: INDUSTRIE SCAFFALATURE ARREDAMENTI—ISA S.R.L., Bastia Umbra (PG) (IT)

( * ) Notice: Subject to any disclaimer, the term of this patent is extended or adjusted under 35 U.S.C. 154(b) by 0 days.

(21) Appl. No.: 15/135,949

(22) Filed: Apr. 22, 2016

(65) Prior Publication Data

US 2016/0309918 A1 Oct. 27, 2016

(30) Foreign Application Priority Data

Apr. 27, 2015 (IT) ..... 102015000013260

(51) Int. Cl.

| | |
|---|---|
| ***A47F 3/04*** | (2006.01) |
| ***A47F 3/12*** | (2006.01) |
| ***A47F 3/00*** | (2006.01) |
| ***E05F 15/611*** | (2015.01) |
| ***E05F 17/00*** | (2006.01) |
| ***E05F 15/616*** | (2015.01) |

(52) U.S. Cl.

CPC ..... *A47F 3/0478* (2013.01); *A47F 3/004* (2013.01); *A47F 3/043* (2013.01); *A47F 3/125* (2013.01); *E05F 15/611* (2015.01); *E05F 15/616* (2015.01); *E05F 17/004* (2013.01)

(58) Field of Classification Search

CPC ..... A47F 3/0478; A47F 3/043; A47F 3/125; A47F 3/0434; A47F 3/004; E05F 15/616; E05F 15/611; E05F 17/004; E05Y 2900/202; F25D 23/00; F25D 23/02; F25D 23/025; F25D 23/028

USPC ..... 49/139, 140, 141, 333, 334, 338; 312/116, 138.1, 139, 139.1, 324, 326; 62/440, 246, 249; 160/185, 186, 199, 160/200

See application file for complete search history.

(56) References Cited

U.S. PATENT DOCUMENTS 4,070,795 A * 1/1978 Lussier ..... E05B 65/102 49/141
4,341,083 A * 7/1982 Ibrahim ..... A47F 3/043 49/340

(Continued)

FOREIGN PATENT DOCUMENTS

WO 2014178629 A1 11/2014

*Primary Examiner* — Daniel J Troy
*Assistant Examiner* — Hiwot Tefera
(74) *Attorney, Agent, or Firm* — Egbert Law Offices, PLLC

(57) ABSTRACT

A display includes at least one revolving door panel hinged to a box frame by means of a hinging means actuated by an actuation means The display has a movement component that can be coupled with the door panel to move the door panel, as well as a fast coupling/uncoupling means for the fast coupling of the movement component with the door panel to actuate the door panel by means of the actuation means, and permit the fast uncoupling of the movement component from the door panel to move the door panel manually, independently from the actuation means.

15 Claims, 9 Drawing Sheets

(56) References Cited

U.S. PATENT DOCUMENTS

| | | | | |
|---|---|---|---|---|
| 8,651,595 | B2 * | 2/2014 | Backhaus | E05F 1/006 312/324 |
| 9,510,695 | B2 * | 12/2016 | Giulietti | E06B 3/367 |
| 9,668,591 | B2 * | 6/2017 | Giulietti | A47F 3/0478 |
| 2009/0033189 | A1 * | 2/2009 | Glanz | E05F 1/105 312/405 |
| 2011/0307098 | A1 * | 12/2011 | Ennis | E05F 15/53 700/275 |
| 2012/0144748 | A1 * | 6/2012 | Ranaudo | E05B 65/08 49/260 |
| 2012/0291471 | A1 * | 11/2012 | Giulietti | E06B 3/367 62/255 |
| 2014/0191642 | A1 * | 7/2014 | Wu | G07F 9/10 312/326 |

* cited by examiner

DISPLAY PROVIDED WITH AUTOMATICALLY AND MANUALLY OPERABLE REVOLVING DOOR PANELS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present patent application for industrial invention relates to a display, in particular a refrigerated display used to display food products. Although in the following description reference is made to a refrigerated display, the present invention is extended to any type of display.

2. Description of Related Art Including Information Disclosed Under 37 CFR 1.97 and 37 CFR 1.98.

Various types of refrigerated displays are known on the market to display food products. FIG. 1 is a perspective view of a display (100) comprising a box frame (1) that comprises a compartment (2) intended to contain foods in general and beverages to be refrigerated, and an opening (4) that provides access to said compartment (2). In correspondence of said opening (4) the display (100) comprises an upper crosspiece (12) and a lower crosspiece (13).

The display (100) comprises two pairs (C) of revolving door panels (3) intended to close the opening (4) of the box frame (1).

Each door panel (3) can be disposed in a plurality of positions comprised between an opening position, wherein the pairs (C) of door panels (3) provide access to the compartment (2), and a closing position, wherein the access to the compartment (2) is prohibited to preserve the internal temperature.

The pairs (C) of door panels (3) open towards the interior of the compartment (2) in such way that, in opening position, the door panels (3) are contained inside the compartment (2).

FIG. 2 is a detailed view of one of the door panels (3) of one of said pairs (C) of door panels (3). Each door panel (3) has a rectangular configuration and comprises:

- a first side (3*d*) directed towards the interior of the compartment (2) when the door panel (3) is in closing position,
- a second side (3*e*) directed towards the outside of the compartment (2) when the door panel (3) is in closing position,
- two vertical lateral edges (3*a*) in parallel position,
- an upper horizontal edge (3*b*) disposed in proximity to the upper crosspiece (12),

- a lower horizontal edge (3*c*) disposed in proximity to the lower crosspiece (13).

The two door panels (3) of each pair (C) are disposed in side by side position and hinged in correspondence of the opposite vertical edges (3*a*) in such a way to rotate in opposite direction around corresponding vertical axes of rotation (Y-Y).

Advantageously, said pairs (C) of door panels (3) are either partially or fully transparent in order to allow the user to see the products contained in the compartment (2).

The display (100) comprises hinging means (7*a*) to hinge the door panels (3) to said box frame (1).

The hinging means (7*a*) are configured in such way that the door panels (3) rotate around the corresponding vertical axes (Y-Y) of rotation.

The hinging means (7*a*) comprise:

- an upper pin (73) that connects the door panel (3) to the upper crosspiece (12) of the box frame (1), and
- an idle lower pin (70) that connects the door panel (3) to the lower crosspiece (13) of the box frame (1).

With reference to FIG. 1, the display (100) comprises an actuation means (M1) for the automatic actuation of each door panel (3).

The actuation means (M1) actuate the hinging means (7*a*) to make the door panel (3) rotate around the axis of rotation (Y-Y); in particular, the actuation means (M1) are connected to the upper pin (73) of the hinging means of each door panel (3).

The upper pin (73) of the hinging means of a door panel (3) is actuated by the actuation means (M1) and permits the rotation of the door panel (3).

The display (100) comprises detection means (R) to detect the presence of the user in proximity to the door panel (3) and/or inside the compartment (2) of the display (100), as shown in FIG. 1.

The detection means (R) detect the presence of the user in proximity to one of the door panels (3) and send an activation signal, either directly or with a manual command, to the actuation means (M1) that consist in a set of electric motors, each of them comprising a drive shaft coupled to one of the upper pins (73) of the door panels (3); in view of the above, when a motor is actuated, the corresponding door panel (3) is rotated in the opening or closing direction according to the direction of rotation of the electric motor.

In case of a refrigerated display, the display (100) comprises means for cold air circulation, which are not shown in the figure, intended to refrigerate the interior of said compartment (2).

A first drawback of this type of displays (100) of the prior art is related with the fact that the door panels (3) cannot be operated if the actuation means (M1) are blocked.

The blocking of said electric motors can be caused either by a breakdown or a blackout.

A second drawback is related to the fact that the door panels (3) are joined to the actuation means (M1) and consequently an incorrect operation of the actuation means (M1) would cause an incorrect actuation of the door panels (3).

Moreover, in case of malfunctioning of the detection means (R), they would not identify the presence of the user's hand inside the compartment (2) and would consequently send an activation signal to the actuation means (M1) to enable the closing of the door panels (3), with the risk of injuring the user's hand by tightening it between the pair of door panels (3) automatically actuated in closing direction.

On the contrary, in case of malfunctioning, said detection means (R) would not identify the presence of a user in front of the door panels (3) and, consequently, would not send an activation signal to the actuation means (M1) to enable the opening of the door panels (3), thus preventing the user from accessing the compartment (2) and picking the desired product.

An additional drawback is that the door panels (3) are difficult to dismount given the fact that the upper pin (73) of each door panel (3) is firmly connected with the drive shaft of one of the electric motors.

Finally, an additional drawback of said displays (100) of the prior art consists in the difficulty encountered in synchronizing the simultaneous movement of the two door panels (3) of each pair (C) of door panels (3); such a drawback occurs when the two electric motors that are used to operate each pair (C) of door panels (3) are not perfectly synchronized originally or lose synchronization during operation.

Last but not least, another drawback is related to the high purchasing and maintenance cost of the set of electric motors provided for the automatic actuation of the door panels (3).

U.S. Pat. No. 4,341,083 discloses a refrigerated merchandiser display cabinet comprising five doors and a system of levers intended to open each door. An opening lever is actuated by an electric motor to open the door of the display cabinet automatically. In particular, the opening lever is intended to rub against a back element obtained in the door panel in such manner that interference between the opening lever and the back element obtained on the door panel determines the automatic opening of the door panel. However, the closing of the door panel is entrusted to a user who must push the door panel manually towards the closing position. In fact, the operation of the opening lever does not allow for closing the door panel automatically because the opening lever and the door are not attached, but only provided with rubbing contact.

WO2014/178629 discloses a showcase comprising doors attached to opening and closing levers; said levers are connected to said doors by means of attachment or release means, such as for example hooks, pins and the like. Each opening lever is actuated by an electric motor. Said attachment and release means allow for mounting and dismounting the door easily with respect to the automatic opening and closing lever. However, said attachment and release means do not allow for moving the door when the opening and closing lever is blocked because of a breakdown of the electric motor used to actuate it.

The main purpose of the present invention is to overcome the drawbacks of the prior art as described above, by devising an improved display that is capable of operating also in case of breakdown or malfunctioning of the actuation means and of the detection means.

The second purpose of the present invention is to devise an improved display wherein the provision of actuation means for the automatic actuation of the door panels is able to avoid detrimental effects for the safety of the users or of the operators in charge of loading and maintaining the display of the invention.

The third purpose of the present invention is to devise an improved display that, in addition to achieving the aforementioned purposes, is provided with actuation means for the pairs of door panels, which are able to solve the aforementioned problems with reference to the synchronization of the opening/closing movement of the door panels of each pair of door panels.

BRIEF SUMMARY OF THE INVENTION

These purposes are achieved according to the invention with the characteristics of the independent claim 1.

Advantageous embodiments appear from the dependent claims.

The display of the invention comprises:

- a box frame comprising a compartment and an opening to access said compartment;
- at least one revolving door panel adapted to close at least partially said opening of the box frame; said at least one door panel being connected to the box frame in such manner to be in closing position and in opening position;
- hinging means used to hinge said at least one door panel to said box frame; said hinging means being configured in such manner that said at least one door panel rotates around an axis of rotation, said at least one door panel being adapted to be in an opening position and a closing position; said hinging means comprising a first pivoting pin that connects and hinges said at least one door panel to the box frame;
- actuation means that actuate said hinging means to make the door panel rotate around said axis of rotation.

The peculiarity of said display is that it comprises:

- a movement component coupled to said at least one door panel to move said at least one door panel; said movement component being coupled to said actuation means and being actuated by said actuation means;
- fast-coupling/uncoupling means for rapidly coupling said at least one door panel and said movement component in such a manner to automatically open and close said at least one door panel by means of the actuation means, and for rapidly uncoupling said at least one door panel from said movement component in such manner to manually open and close said at least one door panel.

It is noted that said fast coupling/uncoupling means consist in connection means that can be coupled or uncoupled without tools, such as magnets or snap joints of male or female type.

BRIEF DESCRIPTION OF THE SEVERAL VIEWS OF THE DRAWINGS

For purposes of clarity, the description of the improved display of the invention continues with reference to the attached technical drawings, which only have an illustrative, not limiting value, wherein:

in FIG. 4 the door panels are in closing position, in FIG. 5 the door panels are in opening position and in FIG. 6 the door panels are in complete opening position;

DETAILED DESCRIPTION OF THE INVENTION

In the following description the parts that are identical or correspond to the parts described above with reference to the prior art are identified with the same numerals, omitting their detailed description.

With reference to FIGS. from 3 to 8, a display (200) according to the invention is described, which operates as a refrigerator, comprising hinging means for hinging the door panels (3) to said box frame (1).

Figure 7:
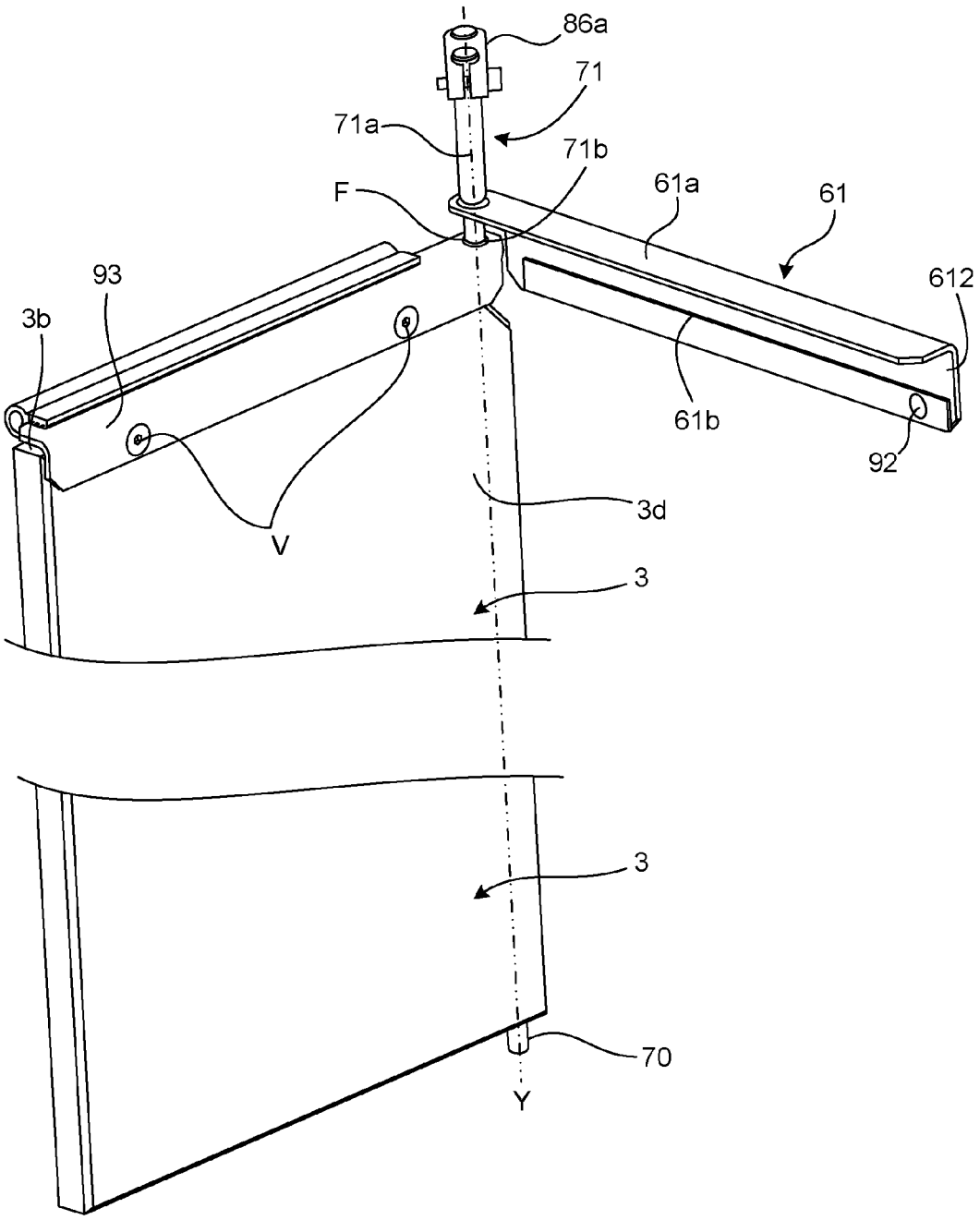
FIG. 7 is a perspective view of the door panel, of the fast coupling/uncoupling means, of the hinging means and of the movement component according to a first embodiment of the invention.

With reference to FIG. 7, the display (200) comprises a movement component (61) that is coupled with the door panel (3) to move the door panel (3).

The movement component (61) is a bar intended to abut against an upper part of the door panel (3).

The movement component (61) is provided with an overturned L-shaped cross-section comprising:

- a vertical portion (61*b*) comprising an abutting side (612) that is directed towards the door panel (3) when the door panel (3) is connected to said movement component (61);
- a horizontal portion (61*a*) that extends above the upper edge (3*b*) of the door panel (3) when the door panel (3) is connected to said movement component (61).

Said horizontal portion (61*a*) comprises a lower side (611) directed towards the upper edge (3*b*) of the door panel (3). The horizontal portion (61*a*) and the vertical portion (61*b*) are perpendicularly connected.

The display (200) comprises fast coupling/uncoupling means (92, 93) to provide for the fast coupling of the movement component (61) with the door panel (3) in order to automatically open and close the door panel (3) by means of the actuation means (M), as well as for the fast uncoupling of the door panel (3) from the movement component (61) in order to open and close the door panel (3) manually.

According to a preferred embodiment of the invention, said fast coupling and uncoupling means (92, 93) comprise magnetic retention means (92, 93) arranged on the door panel (3) and/or on the movement component (61).

With reference to FIG. 7, said fast coupling/uncoupling means (92, 93) advantageously comprise a magnet (92) fixed on the abutting side (612) of the vertical portion (61*b*) of the movement component (61), and a metal bracket (93) that is fixed on the first side (3*d*) of the door panel (3), in proximity to the upper edge (3*b*) of the door panel. Said metal bracket (93) cooperates with said magnet (92).

More precisely, when the door panel (3) is in closing position, said magnet (92) is stopped against said metal bracket (93).

Advantageously, said metal bracket (93) is fixed on the first side (3*d*) of the door panel (3) with screws (V).

According to an alternative embodiment of the invention—which is not shown in the attached figures—said fast coupling/uncoupling means (92, 93) may comprise a first magnet fixed on the first side (3*d*) of the door panel (3), in proximity to the upper edge (3*b*) of the door panel (3), and a second magnet fixed on the abutting side (612) of the movement component (61).

As shown in FIG. 7, the hinging means are configured in such manner that the door panels (3) rotate around an axis of rotation (Y-Y).

The hinging means comprise a first pivoting pin (71) of the door panel (3) connected to the movement component (61), and a second pivoting pin (70) fixed to the door panel (3). The second pivoting pin (70) is in coaxial position to the first pivoting pin (71) and rotates in idle in a hole obtained on the lower crosspiece (13).

The first pivoting pin (71) comprises a first section (71*a*) connected to said actuation means (M) and to said movement component (61), and a second section (71*b*) revolvingly inserted in idle inside a hole (F) provided on the door panel (3).

More precisely, the axis of rotation (Y-Y) of each door panel (3) is advantageously vertical and the first pivoting (71) of each door panel (3) has the first section (71*a*) disposed above the horizontal portion (61*a*) of the movement component (61) and the second section (71*b*) disposed between the upper edge (3*b*) of the door panel and the horizontal portion (61*a*) of the movement component (61).

Figure 4:
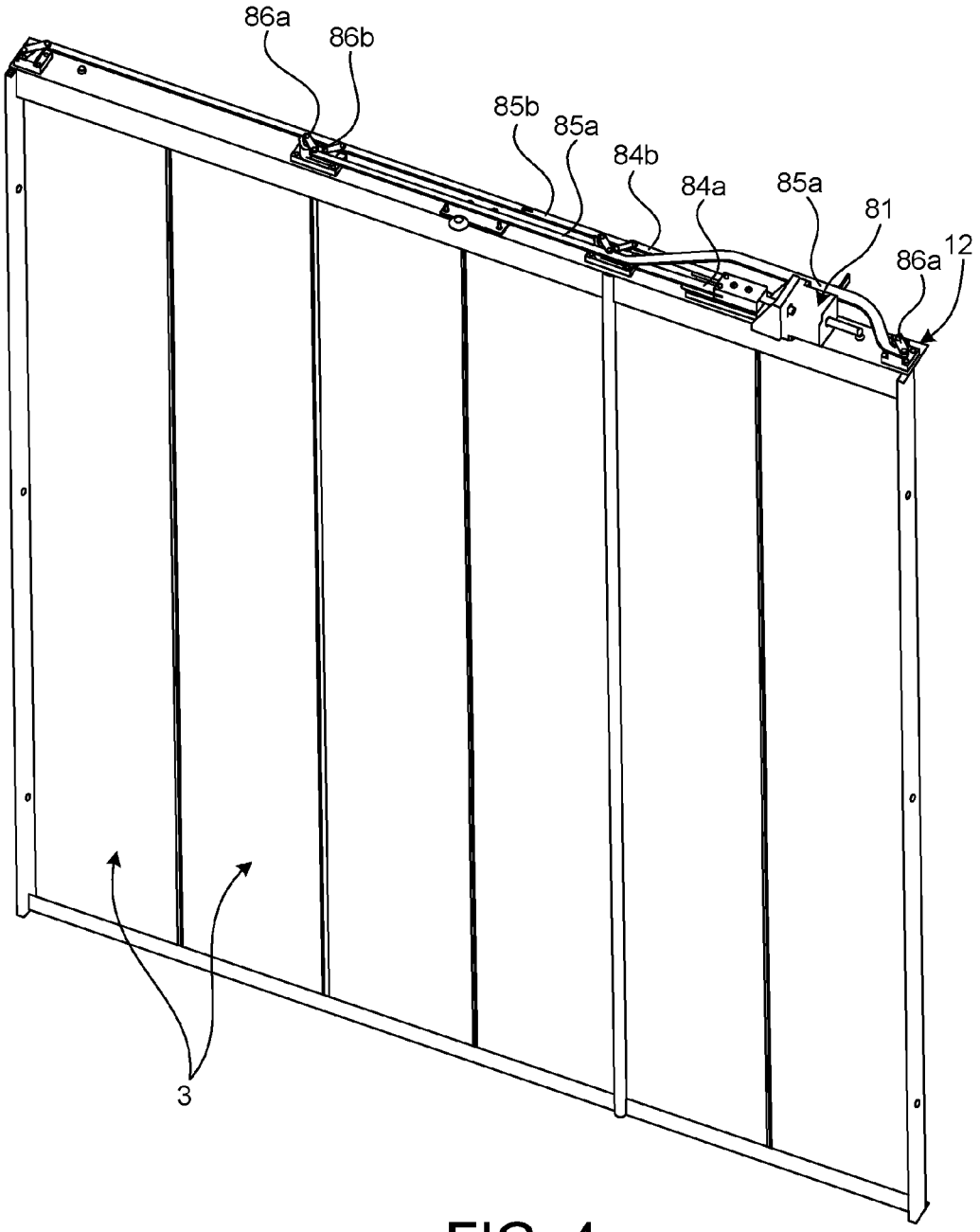
FIGS. 4, 5 and 6 are perspective views of the actuation means and of the door panels of the display of the invention in three different actuation steps of the door panels.
Figure 5:
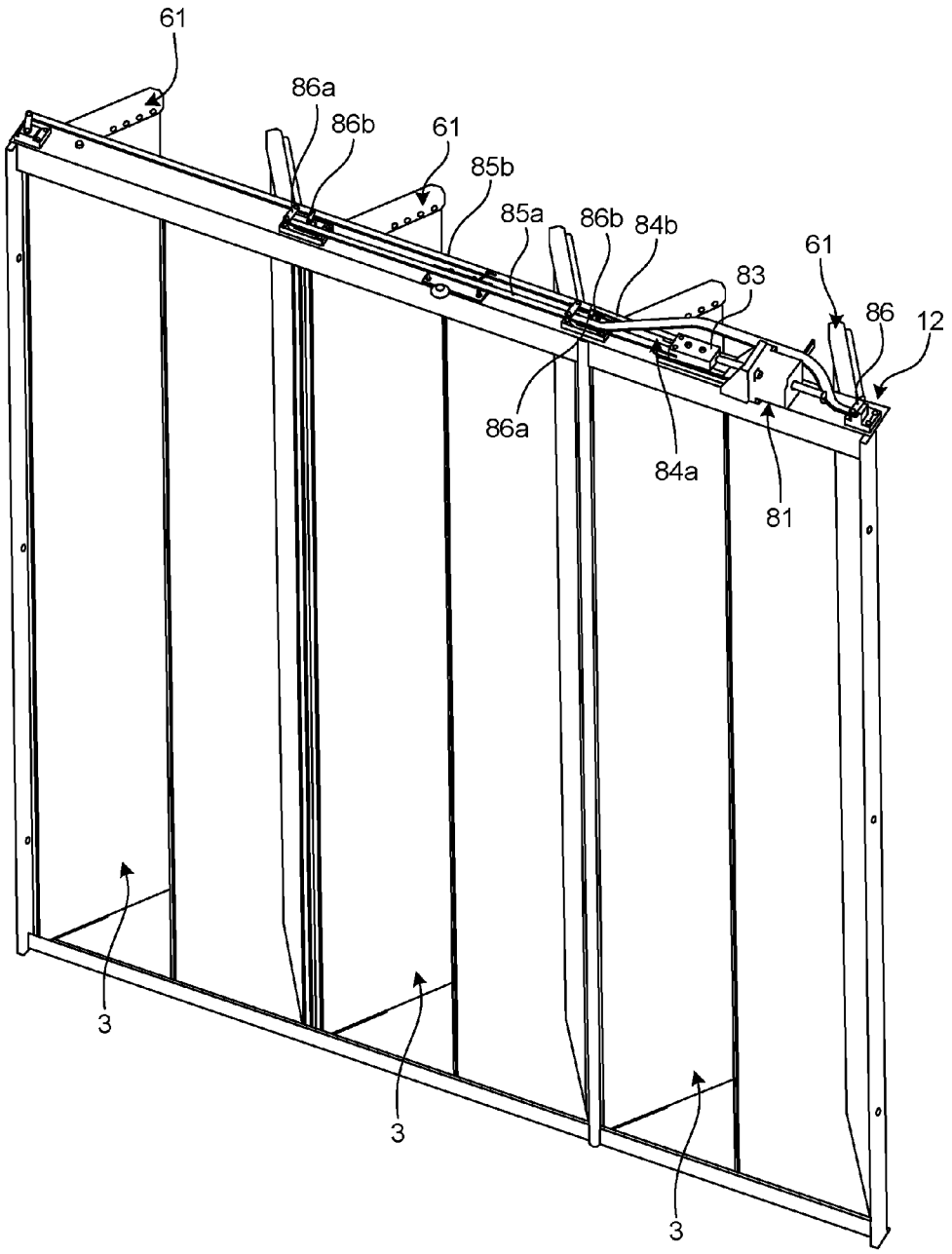
Figure 6:
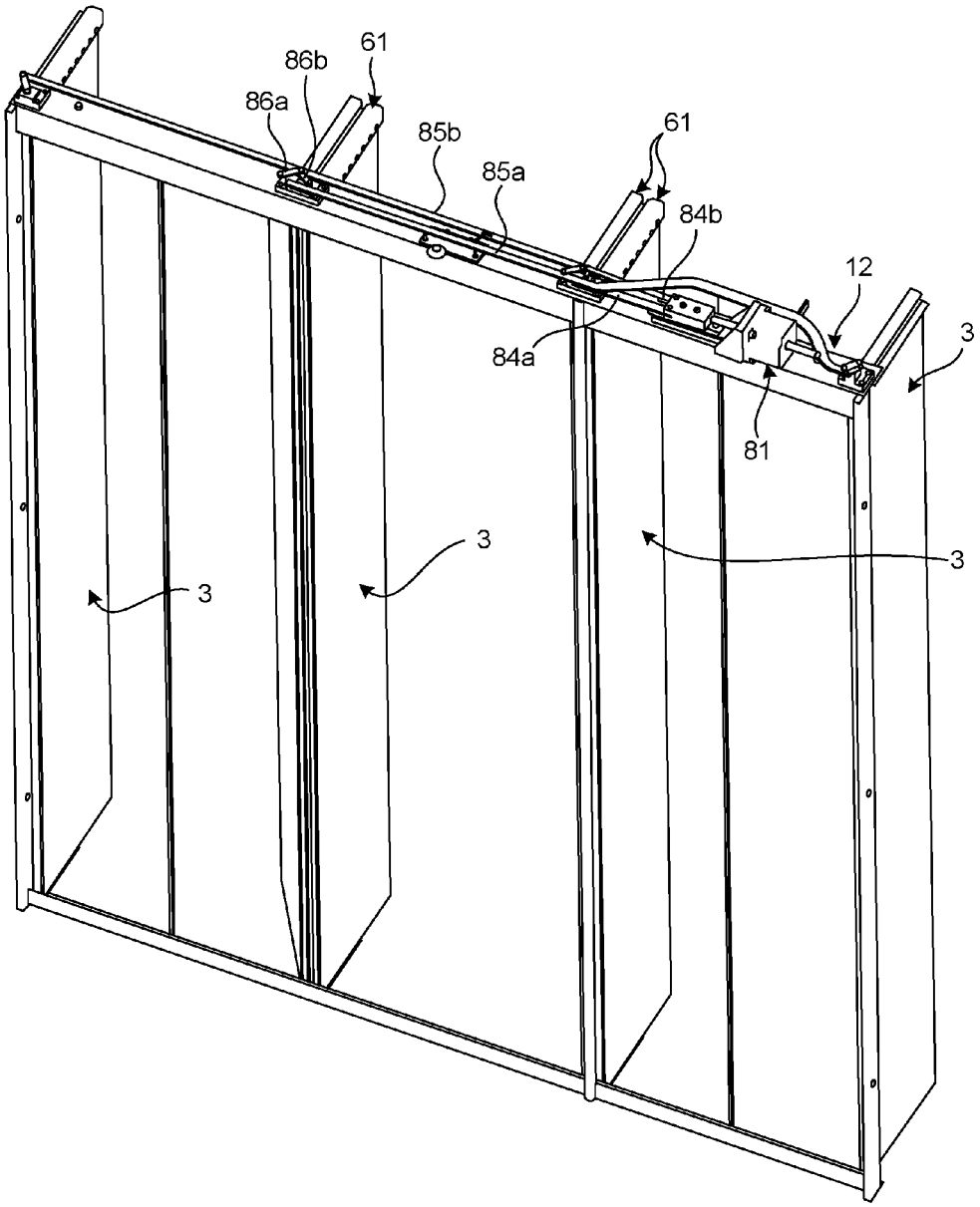

With reference to FIGS. 4, 5 and 6, the display (200) of the invention comprises actuation means (M) to actuate the hinging means and make each door panel (3) rotate around the axis of rotation (Y-Y).

The actuation means (M) simultaneously actuate all the door panels (3), are positioned on the upper crosspiece (12) of the box frame (1) and are connected to the first pivoting pin (71) of each door panel (3).

Figure 5A:
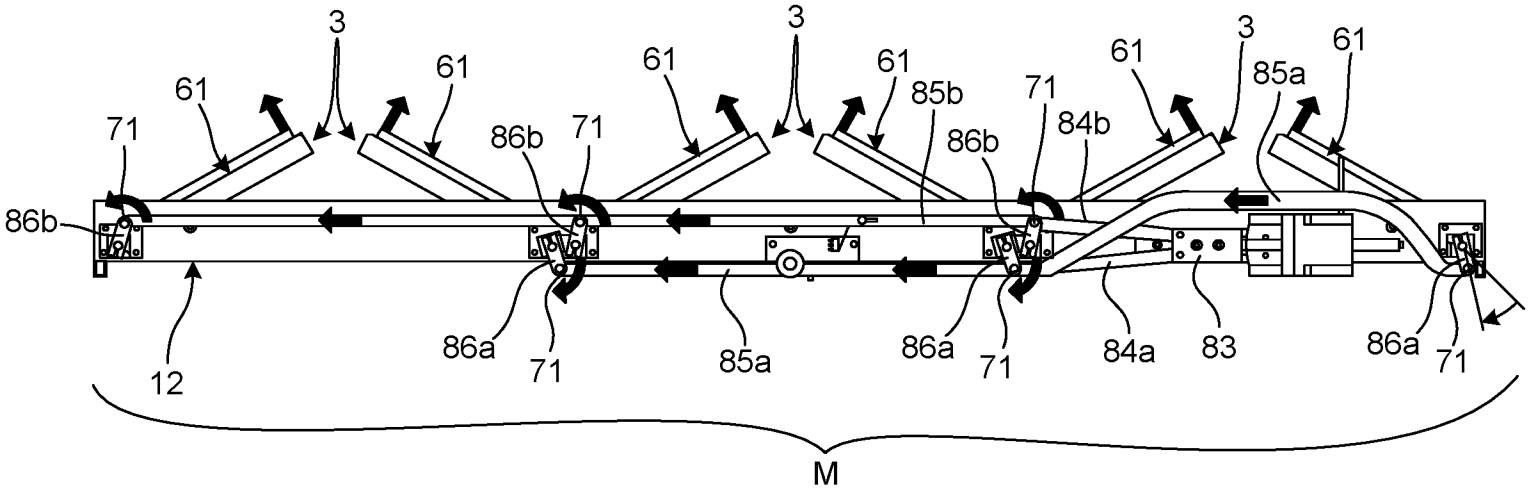
FIG. 5*a* is a top view of the actuation means of the door panels disposed in the position shown in FIG. 5.

With reference to FIG. 5*a*, the actuation means (M) are disposed above the upper crosspiece (12) of the box frame (1). In FIG. 5*a* the arrows indicate the movement made by all the parts of the actuation means (M).

The actuation means comprise:

- an electric motor (81);
- a slide (83) that is actuated by the electric motor (81) and makes alternate rectilinear travels;
- a first connecting rod (84*a*, 84*b*) connected to said slide (83);
- a second connecting rod (84*b*) connected to 5 said slide (83);
- a first transmission lever (85*a*) connected to the first connecting rod (84*a*);
- a second transmission lever (85*b*) connected to the second connecting rod (84*b*);
- a set of first cranks (86*a*)—specifically three first cranks (86*a*)—mutually connected by means of said first transmission lever (85*a*); a first crank (86*a*) of said first cranks (86*a*) being connected to said first connecting rod (84*a*); each first crank (86*a*) being connected to the first pivoting pin (71) of one of the door panels (3); all door panels (3) being connected by means of the first pivoting means (71) to the set of first cranks (86*a*), rotating in the same opening direction, specifically in clockwise direction, as shown in FIG. 5*a;*
- a set of second cranks (86*b*)—specifically three second cranks (86*b*)—mutually connected by said second transmission lever (85*b*); a second crank (86*b*) of said second cranks (86*b*) being connected to said second connecting rod (84*b*); each second crank (86*b*) being connected to the first pivoting pin (71) of one of the door panels (3); all the door panels (3) being connected by means of the first pivoting pins (71) to the set of second cranks (86*b*) rotating in the same opening direction, specifically in anticlockwise direction, as shown in FIG. 5*a*.

The operation of the actuation means (M) is as follows:

- the rectilinear movement of the slide (83) is transmitted by means of the first (84*a*) and the second connecting rod (84*b*) to a first (86*a*) and a second crank (86*b*);
- said first (86*a*) and second crank (86*b*) transmit the motion respectively to the set of first cranks (86*a*) and to the set of second cranks (86*b*) by means of the first (85*a*) and the second transmission lever (85*b*).

The operation of the entire display (200) of the invention is described below, with reference to FIGS. 4, 5 and 6, to better understand the structure of the display according to the invention and appreciate its advantages.

As soon as a user stands in front of the display:

the detection means (R) of the display (200) according to the invention detect the presence of the user in proximity to the door panel (3) of the display (200) and send an activation signal to the electric motor (81);

the electric motor (81) actuates the slide (83);

by means of the aforementioned kinematic mechanism composed of connecting rods (84*a*,84*b*), cranks (86*a*, 86*b*) and transmission levers (85*a*,85*b*), the slide (83) actuates all the first pivoting pins (71);

by rotating, all the first pivoting pins (71) of the door panels (3) actuate all the movement components (61);

all the movement components (61) actuate all the door panels (3).

A first advantage is found when one of the following problems occurs:

incorrect operation of the actuation means (M);

blocking of the actuation means (M);

breakdown or malfunctioning of the detection means (R).

In the past, the door panels (3) were firmly connected to the actuation means (M), whereas in the present invention each door panel (3) can be always actuated, being released with respect to the corresponding movement component (61); in order to do this, it is sufficient to apply a force on the door panel (3) that is capable of overcoming the attraction force between the magnet (92) and the metal bracket (93) that removably connect the door panel (3) to the corresponding movement component (61), and then manually rotate the door panel (3) that is freely pivoted with respect to the upper crosspiece (12) of the box frame (1).

Another circumstance in which the structure of the display (200) of the invention shows its advantages is when the door panels (3) close due to a malfunctioning of the detection means (R), while a user is picking a product that is contained in the interior of the display (200).

In such a situation the door panels (3), which are pushed by the actuation means (M) towards the closing position, interrupt the closing travel, being released with respect to the movement component (61) as soon as the vertical lateral border (3*a*) of the door panel (3) intercepts the user's arm.

An additional advantage of the display (200) consists in the easy mounting and dismounting of the door panels (3), said door panels (3) being hinged to the display (200) only by means of the second pivoting pin (70) and the second section (71*b*) of the first pivoting pin (71).

Furthermore, an additional advantage is represented by the fact that the display (200) comprises only one electric motor (81) used to actuate all the panel doors (3). Having only one electric motor (81), the door panels (3) are moved in a synchronous manner, without having to be calibrated either electrically or electronically.

Figure 8:
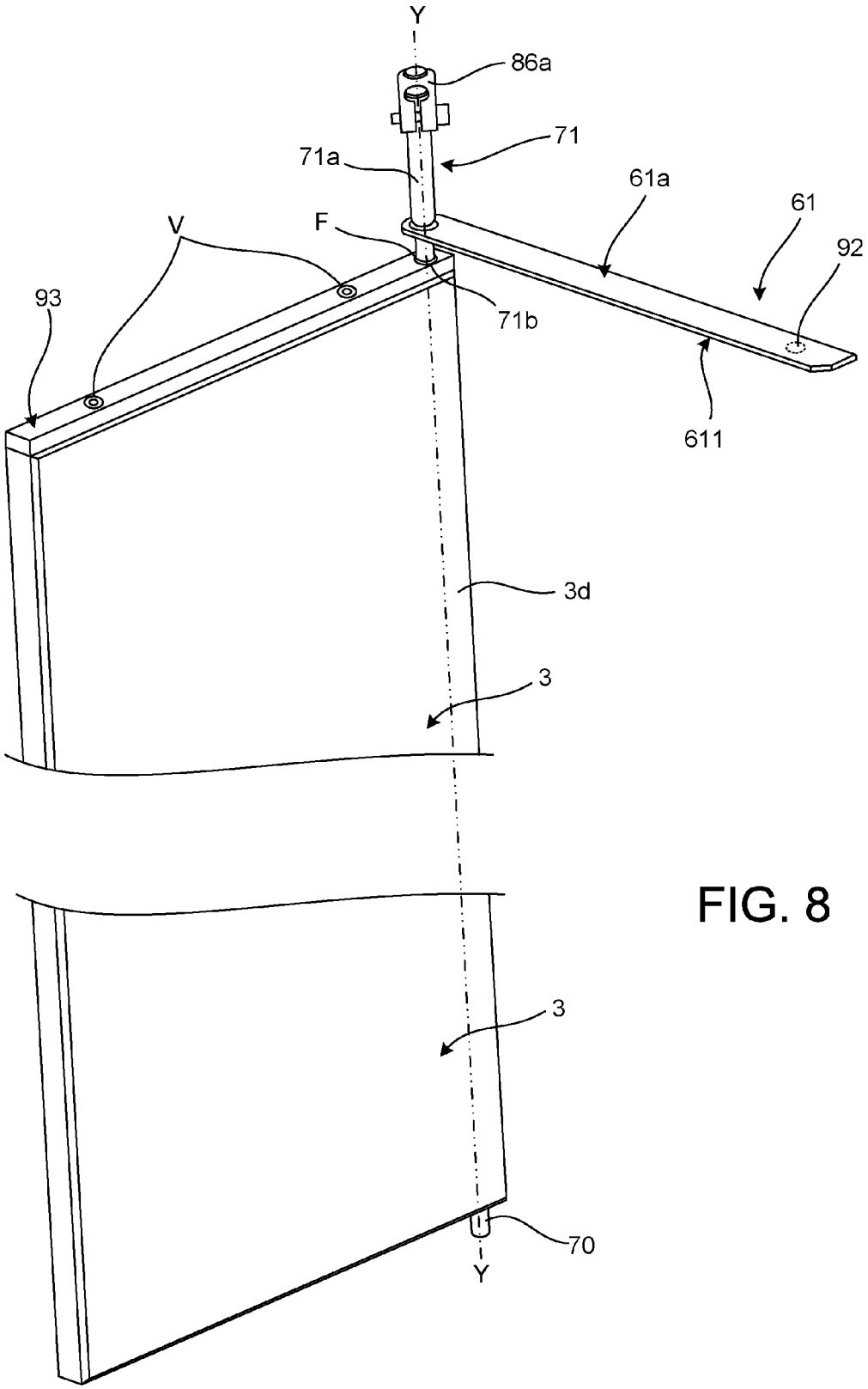
FIG. 8 is a perspective view of the door panel, of the fast coupling/uncoupling means, of the hinging means and of the movement component according to a second embodiment of the invention.

According to an additional embodiment of the invention, which is shown in FIG. 8, the movement component (61) is a plate and comprises a horizontal portion (61*a*) that extends above the upper edge (3*b*) of the door panel.

The horizontal portion (61*a*) comprises a lower side (611) directed towards the upper edge (3*b*) of the door panel (3).

The fast coupling/uncoupling means (92, 93) comprise magnetic retention means and, in particular, advantageously comprise a magnet (92) fixed on the lower side (611) of the horizontal portion (61*a*) of the movement component (61), and a metal bracket (93) fixed on the upper edge (3*b*) of the door panel (3).

Such an arrangement of the fast coupling/uncoupling means (92, 93) provides for an additional advantage, which is represented by the fact that the door panels (3) can be released from the corresponding movement component (61) in both directions, both in opening and closing direction.

Otherwise said, if a door panel (3) is blocked in complete or partial opening position because of malfunctioning, the user can close the door panels (3) by pulling them towards him/her and releasing the door panel (3) from the corresponding movement component (61).

Figure 1:
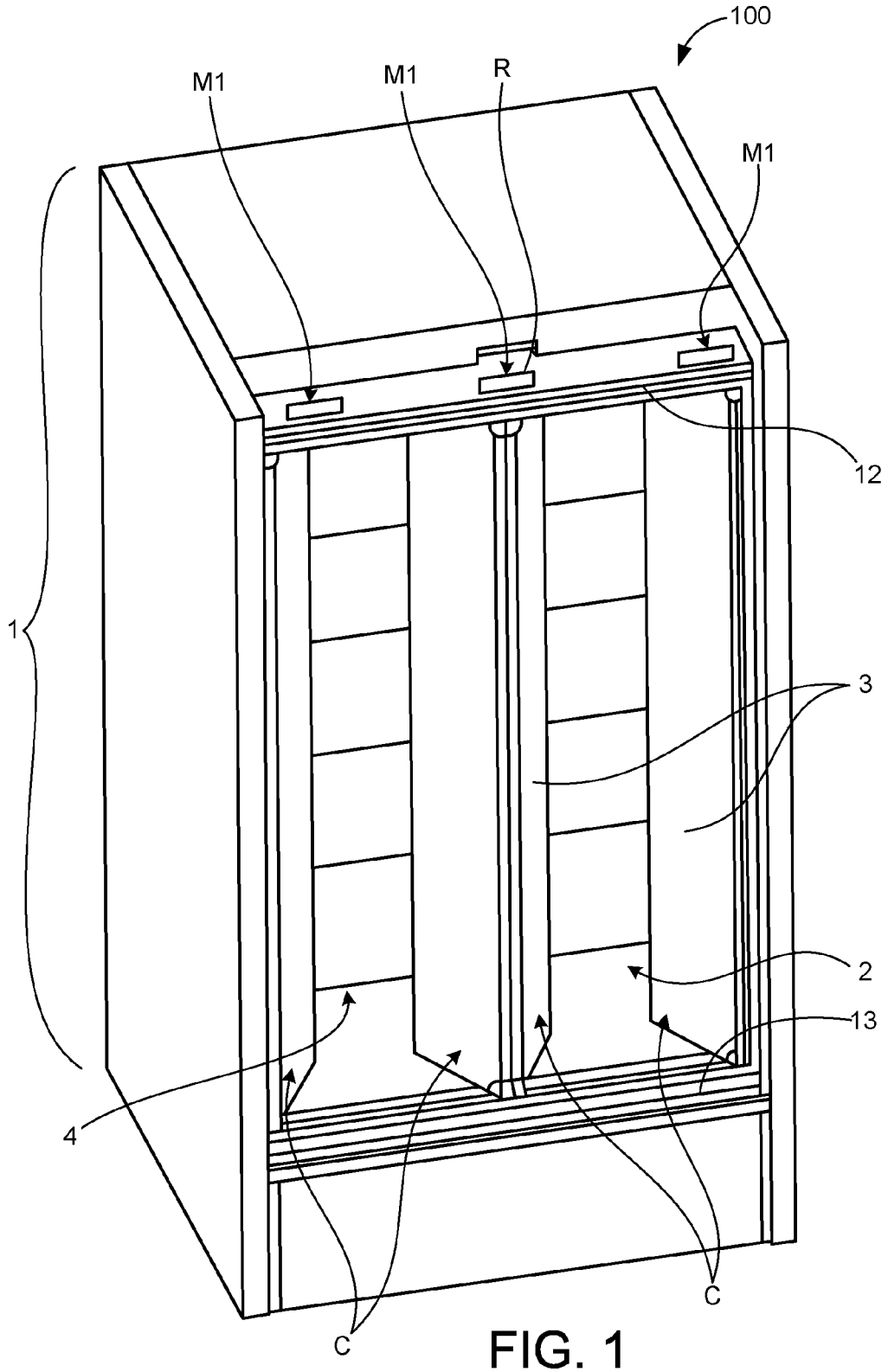
FIG. 1 PRIOR ART
FIG. 1 is a perspective view of a display according to the prior art.
Figure 2:
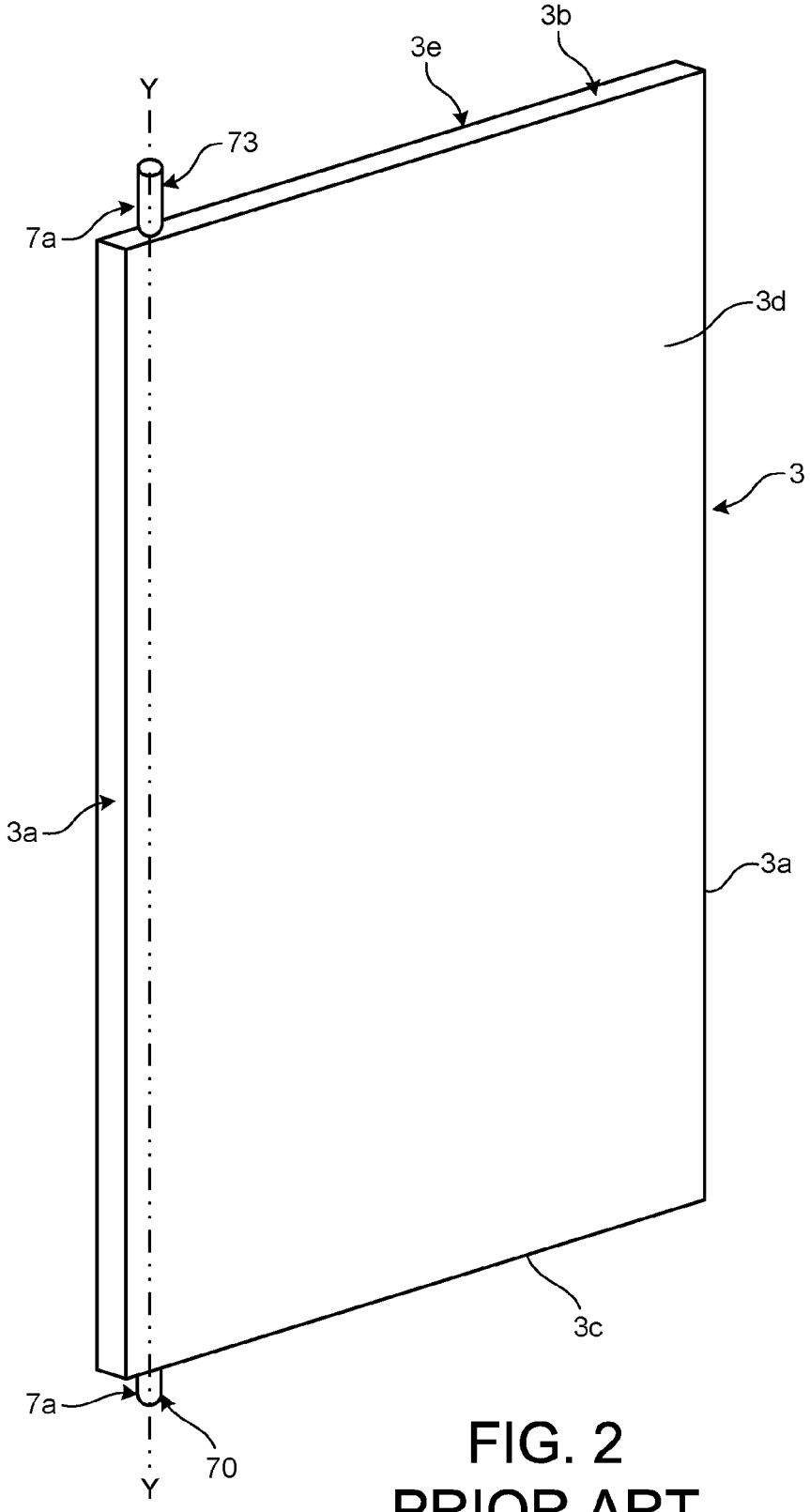
FIG. 2 PRIOR ART
FIG. 2 is a perspective view of a door panel of the display of FIG. 1.
Figure 3:
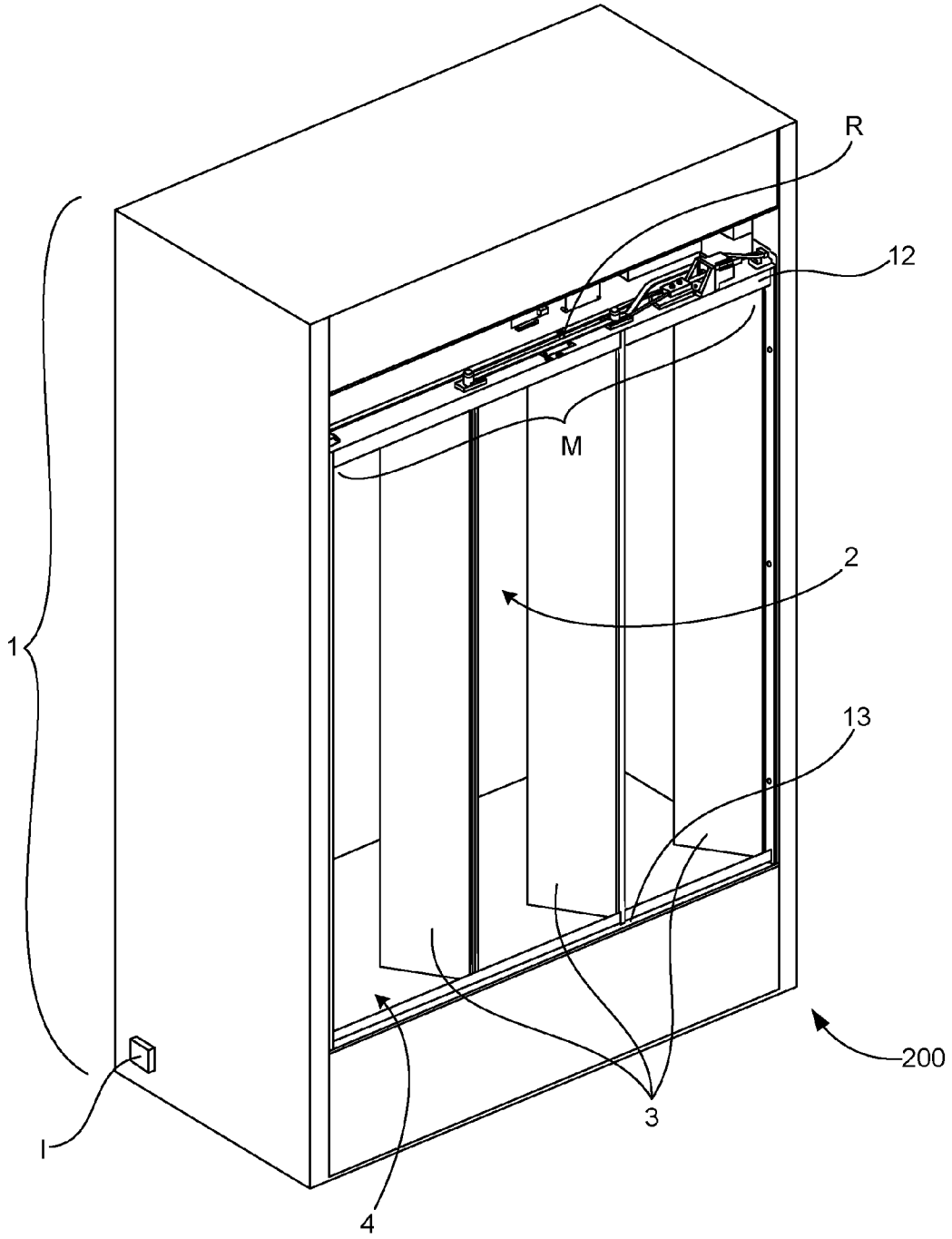
FIG. 3 is a perspective view of a display according to the invention, wherein the door panels are in partial opening position.

With reference to FIG. 3, the display (200) advantageously comprises a switch (I) that can be manually operated by a user to actuate the door panels (3).

In particular, said switch (I) is configured in such a way to send an activation signal to the actuation means (M) that actuate the hinging means to rotate each door panel (3) around its axis of rotation (Y-Y). Y).

I claim:

1. A display apparatus comprising:

a box frame having a compartment and an opening to access said compartment;

at least one revolving door panel adapted to close at least partially said opening of said box frame, said at least one revolving door panel being connected to said box frame so as to have a closing position and an opening position;

a hinge connecting said at least one revolving door panel to said box frame, said hinge being configured such that said at least one revolving door panel rotates around an axis of rotation, said at least one revolving door panel having an opening position and a closing position, said hinge comprising a first pivoting pin that connects said at least one revolving door panel to said box frame;

an actuator that actuates said hinge in order to rotate said at least one revolving door panel around said axis of rotation so that said door panel moves from the opening position to the closing position and vice versa;

a movement component coupled to said at least one revolving door panel to move said at least one revolving door panel, said movement component being coupled to said actuator and being actuated by said actuator;

a coupler for rapidly coupling said at least one revolving door panel and said movement component to automatically open and close said at least one revolving door panel through the actuator and for rapidly uncoupling said at least one revolving door panel from said movement component to manually open and close said at least one revolving door panel, wherein said coupler has a magnetic retainer in said movement component or in said at least one revolving door panel.

2. The display apparatus of claim 1, wherein said first pivoting pin is connected to said actuator and is connected to said movement component.

3. The display apparatus of claim 1, wherein said first pivoting pin comprises:

a first section connected to said actuator and to said movement component; and a second section revolvingly inserted in idle into a hole on said at least one revolving door panel.

4. The display apparatus of claim 1, wherein said movement component is a bar with an overturned "L"-shaped cross section, said bar comprising a vertical portion having an abutting side that is directed towards said at least one revolving door panel.

5. The display apparatus of claim 4, wherein said coupler comprises a magnet fixed on the abutting side of the vertical portion of said movement component, and a metal bracket fixed on said at least one revolving door panel in proximity to an upper edge of said at least one revolving door panel.

6. The display apparatus of claim 1, wherein said movement component is a plate and comprises a horizontal portion that extends above an upper edge of the door panel, said horizontal portion comprising a lower side directed toward an upper edge of the door panel.

7. The display apparatus of claim 6, wherein said coupler comprises a magnet fixed onto the lower side of the said horizontal portion of the movement component, and a metal bracket fixed onto the upper edge of the door panel.

8. The display apparatus of claim 1, comprising one or more pairs of said at least one revolving door panel that rotates towards an interior of stabilizer compartment.

9. The display apparatus of claim 1, wherein said actuator comprises:

an electric motor;

a slide that is actuated by said electric motor and makes alternate rectilinear travels;

a connecting rod connected to said slide;

at least one crank connected to said connecting rod and connected to a first pivoting pin joined to said movement component.

10. The display apparatus of claim 8, wherein said actuator comprises:

an electric motor, a slide that is actuated by said electric motor and makes alternate rectilinear travels;

a connecting rod connected to said slide;

at least two cranks of which at least one of said at least two cranks is connected to said connecting rod, each crank being connected to said first pivoting pin joined to said movement component; and a transmission lever connecting said at least two cranks.

11. The display apparatus of claim 8, wherein the door panel of a same pair of door panels are contra-rotating.

12. The display apparatus of claim 1, wherein said actuator comprises:

an electric motor that is disposed on an upper crosspiece of said box frame;

a slide that is actuated by said electric motor and makes alternate rectilinear travels;

a first connecting rod connected to said slide;

a second connecting rod connected to said slide;

a first transmission lever connected to the first connecting rod;

a second transmission lever connected to said second connecting rod;

a set of first cranks mutually connected by said first transmission lever, a first crank of said set of first cranks being connected to said first connecting rod, each first crank being connected to said first pivoting pin of the door panel; and a series of second cranks mutually connected by said second transmission lever, a second crank of said series of second cranks being connected to said second connecting rod, each second crank being connected to said first pivoting pin of the door panel.

13. The display apparatus of claim 1, wherein the axis of rotation of the door panel is vertical.

14. The display apparatus of claim 1, further comprising:

a detector that detects a presence of a user in proximity to said at least one revolving door panel, said detector being configured to send a control signal to the actuator that actuates said hinge to rotate said at least one revolving door panel around the axis of rotation.

15. The display apparatus of claim 1, further comprising:

a manually operated switch configured to send a control signal to the actuator that actuates said hinge to rotate said at least one revolving door panel around the axis of rotation.

* * * * *